US005079476A

United States Patent [19]

Kane

[11] Patent Number: 5,079,476

[45] Date of Patent: Jan. 7, 1992

[54] ENCAPSULATED FIELD EMISSION DEVICE

[75] Inventor: Robert C. Kane, Woodstock, Ill.

[73] Assignee: Motorola, Inc., Schaumburg, Ill.

[21] Appl. No.: 477,686

[22] Filed: Feb. 9, 1990

[51] Int. Cl.[5] ..... H01J 1/46; H01J 1/02

[52] U.S. Cl. ..... 313/308; 313/309; 313/306; 313/336; 313/351

[58] Field of Search ..... 313/308, 309, 336, 351, 313/618, 306

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,883,760 | 5/1975 | Cunningham, Jr. | 313/309 |
| 3,894,332 | 7/1975 | Nathanson et al. | 313/409 |
| 3,921,022 | 11/1975 | Levine | 313/309 |
| 3,970,887 | 7/1976 | Smith et al. | 72/56 |
| 3,998,678 | 12/1976 | Fukase et al. | 313/309 |
| 4,008,412 | 2/1977 | Yuito et al. | 313/309 |
| 4,178,531 | 12/1979 | Alig | 313/409 |
| 4,307,507 | 12/1981 | Gray et al. | 313/309 |
| 4,513,308 | 4/1985 | Greene et al. | 313/309 |
| 4,578,614 | 3/1986 | Gray et al. | 313/309 |
| 4,685,996 | 8/1987 | Busta et al. | 156/628 |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,956,574 | 9/1990 | Kane | 313/306 |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM; pp. 776–779.

Advanced Technology: flat cold-cathode CRTs, by Ivor Brodie, Information Display 1/89, pp. 17–19.

Field-Emitter Arrays Applied to Vacuum Flourescent Display, by Spindt et al. Jan., 1989 issue of IEEE Transactions on Electronic Devices, pp. 225–228.

Field Emission Cathode Array Development For High--Current Density Applications by Spindt et al., dated Aug., 1982 vol. 16 of Applications of Surface Science, pp. 268–276.

*Primary Examiner*—Donald J. Yusko
*Assistant Examiner*—Diab Hamadi
*Attorney, Agent, or Firm*—Steven G. Parmelee

[57] ABSTRACT

A solid state field emission device having a cathode that is peripherally disposed about the anode and axially displaced with respect thereto. The device itself is encapsulated, readily manufacturable, and has comparable operating properties, vis-a-vis one another when manufactured in quantity.

3 Claims, 1 Drawing Sheet

ENCAPSULATED FIELD EMISSION DEVICE

TECHNICAL FIELD

This invention relates generally to field emission devices, and more particularly to field emission devices that embody a non-planar geometry.

BACKGROUND OF THE INVENTION

Field emission phenomena is known. Vacuum tube technology typically relied upon electron emission as induced through provision of a heated cathode. More recently, solid state devices have been proposed wherein electron emission activity occurs in conjunction with a cold cathode. The advantages of the latter technology are significant, and include rapid switching capabilities and resistance to electromagnetic pulse phenomena.

Notwithstanding the anticipated advantages of solid state field emission devices, a number of problems are currently faced that inhibit wide spread application of this technology. One problem relates to unreliable manufacturability of such devices. Current non-planar configurations for these devices require the construction, at a microscopic level, of emitter cones. Developing a significant plurality of such cones, through a layer by layer deposition process, is proving a significant challenge to today's manufacturing capability. Planar configured devices have also been suggested, which devices will apparently be significantly easier to manufacture. Such planar configurations, however, will not necessarily be suited for all hoped for applications.

Accordingly, a need exists for a field emission device that can be readily manufactured using known manufacturing techniques, and that yields a device suitable for application in a variety of uses.

SUMMARY OF THE INVENTION

These needs and others are substantially met through provision of the field emission device disclosed herein. A field emission device constructed in accordance with this invention includes generally an anode and a cathode that is peripherally disposed about the anode.

In one embodiment of the invention, the cathode is axially displaced with respect to the anode.

In yet another embodiment of the invention, a gate is also peripherally disposed about the anode, and axially displaced with respect to both the anode and the cathode.

In a yet further embodiment of the invention, an edge provided on the cathode supports electron emission induced by an enhanced electric field in proximity to the edge.

BEST MODE FOR CARRYING OUT THE INVENTION

Figure 1:
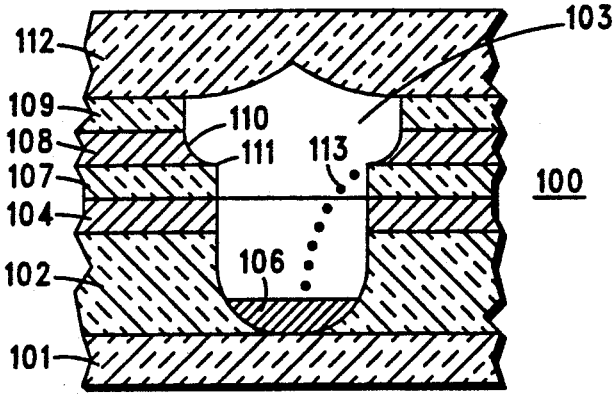
FIG. 1 comprises a side elevational sectioned view of a field emission device constructed in accordance with the invention.

As depicted in FIG. 1, a field emission device constructed generally in accordance with this invention has been depicted by the reference numeral 100. The device (100) includes a support substrate (101) comprised of silicon, quartz, or other insulating material. In a different embodiment, it may be appropriate to use a conductive material for this layer. When using an insulating layer such as described above, appropriate conductive paths may be formed on the surface to electrically couple the anode of the device as described below in support of the intended application of the device.

Another insulating layer (102), in this case comprised of polyimide material or the like, is deposited atop the support layer (101). A suitable etching process may then be utilized to form a cavity (103) in this second insulating layer (102). Preferably, the cavity (103) will extend sufficiently deep to provide access to a conductive path located in conjunction with the cavity and as formed on the support substrate (101).

A conductor layer (104) is then applied through an appropriate metallization process to the top of the second insulating layer (102). This metallization layer (104) comprises a gate. During this process, a metallization layer may also be deposited within the cavity (103), and this metallization layer forms the anode (106) for the device (100).

An appropriate masking material is then deposited within the cavity (103) to protect the anode (106), and another insulating layer (107) is deposited or grown atop the gate layer (104). Following this, another metallization layer (108) is deposited. Another insulating layer (109) can then be added.

An appropriate etching process can then be utilized to etch away at the sides of the last metallization layer (108), as well as the last insulation layer. This etching process should be one calculated to etch anisotropically. Such a process will yield an exposed metallization surface (110) having an inclined surface, and yielding a relatively well defined edge (111). This last metallization layer (108) comprises the cathode for the device (100), and the edge (111) constitutes a geometric discontinuity that contributes field enhancing attributes in favor of the operation of the device (100).

An etching or lift-off process may also be used to remove material deposited within the cavity (103) to again expose the anode (106). A low angle vapor phase deposition process is then utilized to deposit an appropriate insulating layer (112), such as aluminum oxide or silicon oxide, atop the structure (100) to thereby yield an encapsulated device. Preferably, the latter deposition process will occur in a vacuum, such that the cavity (102) will contain a vacuum, again in favor of the anticipated operation of the device.

So configured, with appropriate potentials supplied to the cathode (108) and the anode (106), electrons (113) will be emitted (primarily from the geometric discontinuity represented by the edge (111) of the cathode (108) and move towards the anode (106). This flow can be generally modulated through appropriate control of the gate (104) in accordance with well understood methodology.

In another embodiment of the device (100) the intermediate metallization layer (104) and insulating layer (107) associated therewith could be excluded. This would result in a two electrode device, such as a diode.

Figure 2B:
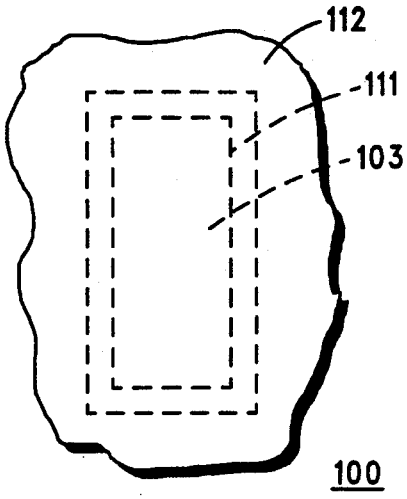
FIGS. 2A and B comprise top plan views of two embodiments of the invention.
Figure 2A:
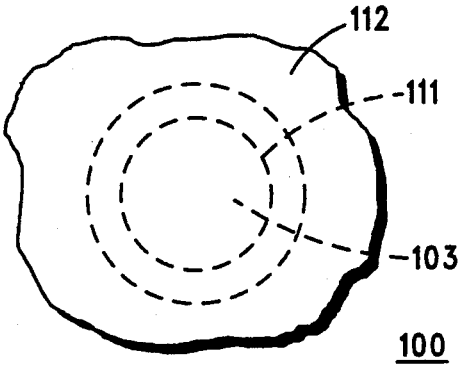

Depending upon the particular application, the cavity (103) may be formed as a circle (see FIG. 2*a*), as a rectangle (see FIG. 2*b*), or as any other multi-sided chamber. Importantly, in any of these embodiments, the cathode (108) is peripherally disposed about the anode (106).

In these particular embodiments, the cathode is also axially displaced with respect to the anode, and in the three electrode device as depicted in FIG. 1, the gate is also peripherally disposed about the anode and axially displaced with respect to the remaining two electrodes.

Figure 3:
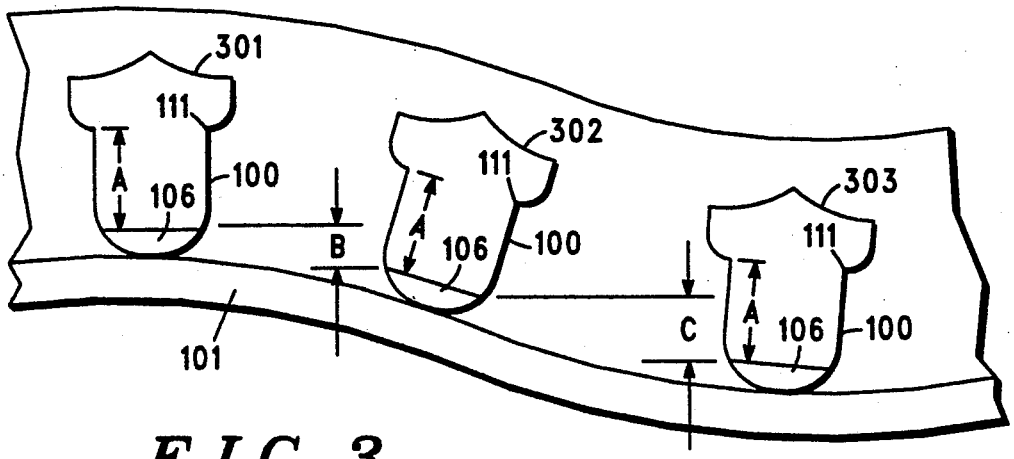
FIG. 3 comprises a side elevational reduced scale view of a plurality of field emission devices constructed in accordance with the invention on a common substrate.

An important benefit of this device (100) will now be explained with reference to FIG. 3. Field emission devices such as the one described above are constructed on a microscopic level. As a result, the support substrate (101) will typically not be exactly planar. Instead, variations in the surface can and will occur as generally suggested in FIG. 3. Due to these varying surface perturbations a vertical displacement (B) occurs between the level of the anode (106) of a first device (301) as compared to the anode (106) of a second device (302). Similarly, a different displacement (C) exists between the anode (106) of the second device (302) and the level of the anode (106) of the third device (303).

Notwithstanding these naturally occurring variations, the distance between the cathode edge (111) and the anode (106) of each device (301, 302, and 303) remains substantially equal (A). This correspondence between devices contributes to predictable performance of each device and of the devices in the aggregate. At the same time, these devices are readily manufacturable using known metallization, oxide growth, etching, and vapor phase deposition techniques.

What is claimed is:

1. A field emission device comprising:

A) an anode;

B) a gate peripherally disposed about the anode; and

C) a cathode peripherally disposed about the anode.

2. The field emission device of claim 1 wherein the anode, gate, and cathode are each axially displaced with respect to one another.

3. An electronic device comprised of a plurality of field emission devices, wherein each of the field emission devices includes:

A) an anode; and

B) a cathode; wherein for each field emission device, the anode is positioned a distance from its related cathode by an amount substantially equal to a first value, and wherein all of the anodes are not substantially coplanar to each other.

* * * * *